United States Patent [19]

Ferguson

[11] Patent Number: 4,603,611

[45] Date of Patent: Aug. 5, 1986

[54] FEED SYSTEM FOR PUNCH PRESS

[76] Inventor: Dennis R. Ferguson, P.O. Box 767, Willoughby, Ohio 44094

[21] Appl. No.: 628,393

[22] Filed: Jul. 6, 1984

[51] Int. Cl.[4] ..... B21D 28/02

[52] U.S. Cl. ..... 83/50; 83/69; 83/71; 83/153; 83/277; 83/282

[58] Field of Search ..... 83/69, 71, 153, 277, 83/282, 50; 226/150, 162

[56] References Cited

U.S. PATENT DOCUMENTS

| | | | |
|---|---|---|---|
| 2,019,848 | 11/1935 | Ferris et al. | 83/69 |
| 2,359,140 | 9/1944 | Meitner . | |
| 2,961,138 | 11/1960 | Kaye . | |
| 3,123,270 | 3/1964 | Olson | 226/162 X |
| 3,125,270 | 3/1964 | Ronfeldt . | |
| 3,348,440 | 10/1967 | Jensen | 83/69 X |
| 3,512,438 | 5/1970 | Burdge | 83/277 X |
| 3,546,991 | 12/1970 | Swendsen et al. | 83/69 |
| 3,757,552 | 9/1973 | Ritter et al. | 83/69 X |
| 3,872,751 | 3/1975 | Schmidt | 83/69 |
| 3,991,926 | 11/1976 | Marks | 83/277 X |
| 4,399,937 | 8/1983 | Scribner . | |

OTHER PUBLICATIONS

"Barnes ABECO Quality Feeders, Malfunction Detectors and Controls", Barnes Engineering Company Limited, 380 Tapscott Rd., Unit 6, Scarborough, Ontario M1B 2Y8.

*Primary Examiner*—Frank T. Yost

*Attorney, Agent, or Firm*—Porter & Troll, Co.

[57] ABSTRACT

A feed system for a punch press includes a first clamping and advancing mechanism for gripping feed stock and moving it toward the press, and a second clamping and advancing mechanism for gripping the stock and conveying the stock away from the press. A controller causes the first clamping and advancing mechanism to be operated until a predetermined number of punching operations have been performed upon the stock while the second clamping and advancing mechanism remains inoperative. After the predetermined number has been attained, the second clamping and advancing mechanism is activated and punch operations continue until a second predetermined count has been attained. Thereafter, the stock is conveyed away from the press. The invention permits stock to be conveyed through the press very rapidly, and it prevents damage to the press by accurately determining the position of the stock relative to the press.

12 Claims, 3 Drawing Figures

FEED SYSTEM FOR PUNCH PRESS

BACKGROUND OF THE INVENTION

1. Field of the Invention

The invention relates to devices for feeding lengths of strip stock or the like through a punch press, wherein the strips are advanced incrementally and punching of the stock occurs sequentially.

2. Description of the Prior Art

Various types of devices for feeding stock to a punch press are known. For example, the patent to Ferris, U.S. Pat. No. 2,019,848, discloses a self-feeding press adapted to operate on strip stock of approximately equal predetermined lengths. A pair of so-called grippers are disposed at the feed end and the exit end of the press. The grippers clamp a piece of feed stock between opposed jaws and then incrementally advance the stock in a feed direction. Thereafter, the jaws are released, the grippers are returned to their starting position, whereupon the jaws re-engage the stock. As the work pieces are advanced through the press, the stock is handled first by one gripper, then by both grippers, then by the gripper located at the exit end of the press. In order to control operation of the grippers, it is assumed that the lengths of feed stock are the same and are known in advance. A mechanical mechanism counts the number of operations to be performed upon each strip. The mechanical mechanism includes a control chain having a predetermined number of links. In order to adjust the number of operations being performed by the press, chains of different lengths are provided, and a number of idler sprockets are provided to accommodate these chains of different lengths. Unfortunately, the described approach is complex, expensive, and difficult to use. It is particularly undesirable to shut down the machine to change control chains and adjust sprockets whenever it is desired to procress strips of different lengths.

More recent devices are known that have advantages over the device disclosed by Ferris. For example, the patents to Olson, U.S. Pat. No. 3,123,270 and Burdge, U.S. Pat. No. 3,512,438, disclose clamping devices disposed on either side of a punch press. The Olson device includes movable jaws on either side of the press, as well as stationary jaws disposed on either side of the press. The movable jaws are slideable on rails and are connected pneumatically so that they move back and forth, and open and close, in unison. Similarly, the stationary jaws open and close in unison.

The Burdge device represents somewhat of an improvement over the Olson device in that the Burdge device initiates cyclic operation of infeed clamps when strip stock has advanced to a predetermined point relative to a punching station, although it initiates cyclic operation of outfeed clamps irrespective of the presence of strip stock. In order to detect the presence of strip stock, Burdge discloses a microswitch located immediately upstream of the press.

Both the Burdge and Olson devices enable strip stock to be processed relatively rapidly, and enable operation of the press to be controlled relatively easily. Unfortunately, both the Olson and Burdge devices fail to address certain concerns. One of these concerns is the technique by which the presence or absence of strip stock is detected and the technique by which operation of the press is controlled. The Burdge patent, for instance, causes both the infeed and outfeed clamps to be operated simultaneously. It is left to the operator to determine when to commence operation of the press and to cease operation of the press. Using either of the Burdge or Olson devices, it is possible for the tail end of the strip stock to be partially positioned at the punching station such that the punch will be non-uniformly loaded, possible causing damage to the punch. Although devices are known for detecting the presence of strip stock at the punching station and ensuring that a punching operation occurs only when the stock completely covers the punching station, such devices are very expensive and bulky.

Prior devices such as those disclosed by Burdge and Olson also fail to address the problem of enabling the operator to feed strip stock to the press as fast as possible. By continuously cycling the infeed and outfeed clamps, the devices require the operator to pay attention to the position of the strip being processed. This, in turn, slows the operator from rapidly feeding additional pieces of strip stock. Known prior feeding devices do not permit the operation of the punch to be controlled automatically such that the operator can devote attention to feeding stock to the press as fast as possible.

SUMMARY OF THE INVENTION

The present invention provides a new and improved feed system for delivering stock to a punch press whereby the foregoing disadvantages are overcome. The invention in its preferred form includes a punch press having a punching station, an infeed portion upstream of the punching station, an outfeed portion downstream of the punching station, and a control mechanism to control operation of the punch. The invention includes a first clamping and advancing means upstream of the infeed portion for gripping the stock and advancing the stock through the infeed portion toward the punching station. The invention also includes a second clamping and advancing means downstream of the outfeed portion for gripping the stock and advancing the stock through the outfeed portion away from the punching station. A control means for operating the press also is provided, the control means being in communication with the first clamping and advancing means, the second clamping and advancing means, and the press. The control means operates the press a first predetermined number of cycles to perform a first predetermined number of operations upon a given piece of stock. The first predetermined number of cycles basically is that which enables the leading edge of the stock to be initially engaged by the second clamping and advancing means.

After the first predetermined count has been attained, the second clamping and advancing means is activated. The second clamping and advancing means continues to run for a second predetermined number of operations. The second predetermined number of operations is determined by the operator such that the tail end of the stock is positioned at the punching station to completely cover the punching station. After the second predetermined count has been attained, the operation of the press is stopped, regardless of whether the operator tries to operate the press manually.

An unload mechanism also is provided, the unload mechanism being disposed downstream of the second clamping and advancing means. After the second predetermined count has been attained, the second clamping and advancing means is released and the unload mechanism is activated so as to convey stock away from the outfeed portion.

The invention enables the operator to rapidly position stock at the infeed portion of the press. Once the stock has been positioned at the infeed portion, it essentially is processed automatically, and without possibility of damage to the press. By use of the present invention, exceedingly rapid production rates on the order of 6,000 parts per hour can be obtained. This is in comparison with production rates available with previous feeding devices of about 1,400 parts per hour. Further, this significant increase in production is available at very little increase in component cost.

DESCRIPTION OF THE PREFERRED EMBODIMENT

Figure 1:
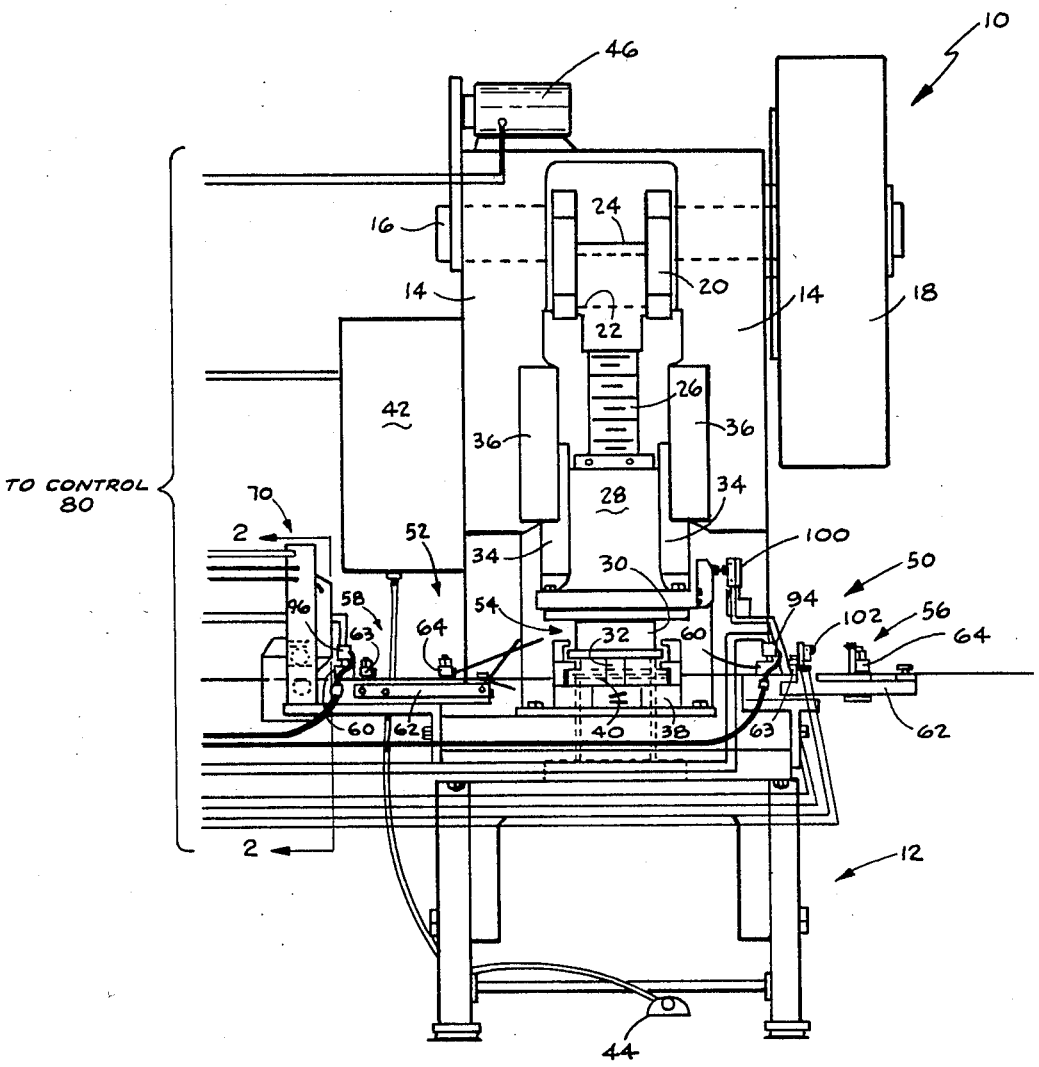
FIG. 1 is a side elevational view of a punch press employing a feed system according to the invention.

Referring to FIG. 1, a punch press 10 is shown. The press 10 includes a lower support framework 12, and laterally spaced standards 14 extending upwardly from the support frame 12. A shaft 16 is supported for rotation at the upper ends of the standards 14 and carries at one end a fly wheel 18. A motor and reduction gear (not shown) are provided to drive the shaft 16 and the fly wheel 18. The shaft 16 carries an eccentric 20 at a location intermediate the standards 14. The eccentric 20 works in a slot 22 formed in a crosshead 24. The crosshead 24 is formed at the end of a vertically reciprocating connecting rod 26. An anvil 28 is disposed at the lower end of the connecting rod 26. A crosshead 30 is secured to the underside of the anvil 28 and carries on its surface a punch 32. The connecting rod 26 is constrained for vertical movement by laterally extending flanges 34 secured to the sides of the anvil 28. The flanges 34 slidingly engage channels 36 formed in the standards 14.

A die block 38 is disposed beneath the crosshead 30 and includes an opening 40 of the same size and shape as the punch 32. Upon vertical reciprocating movement of the connecting rod 26, the punch 32 periodically will move into and out of the opening 40, thereby punching stock material that may have been interposed between the punch 32 and the opening 40 downwardly through the opening 40. The stock material thus punched can be collected in a bin or conveyor for such subsequent use as may be desired.

A control mechanism, or press control 42, is secured to one of the standards 14 and enables an operator to properly control operation of the press 10. The control mechanism 42 controls the speed at which the connecting rod 26 is reciprocated, and it also controls the stop and start operation of the press 10. Input to the control mechanism 42 is provided by the operator through a foot petal 44. A rotary cam switch 46 is secured atop one of the standards 14 and is connected to the shaft 16 such that an electrical feedback signal from the shaft 16 is possible.

The press 10 includes an infeed portion 50 through which stock to be punched is fed, an outfeed portion 52 through which punched stock is fed, and a punching station 54 where punching operations occur. The components located at the punching station 54 have been described already. A first clamping and advancing mechanism 56 is disposed immediately upstream of the feed portion 50. A second clamping and advancing mechanism 58 is disposed immediately downstream of the outfeed portion 52. A pair of inclined guide brackets 59 are secured to the upstream portion of the second clamping and advancing mechanism in order to ensure that the leading edge of stock material is properly inserted into the second clamping and advancing mechanism 58. Both the first and second clamping and advancing mechanisms 56, 58 are pneumatically actuated. The mechanisms 56, 58 each include an air valve 60, guide rails 62, a fixed clamp 63, and a movable clamp 64. Each of the clamping and advancing mechanisms 56, 58 engage a piece of strip stock, clamp it, advance it in a given direction, release the grip on the stock, return to the starting position, re-grip the stock, and once again advance the stock. This sequential clamping, advancing, retreating, re-clamping, and re-advancing sequence is repeated as often and as fast as desired to move a piece of strip stock through the infeed portion 50 and the outfeed portion 52. Suitable clamping and advancing mechanisms 56, 58 are comercially available from P/A Industries, Inc. of Bloomfield, Conn. 06002 under the model designation 14192.

Figure 2:
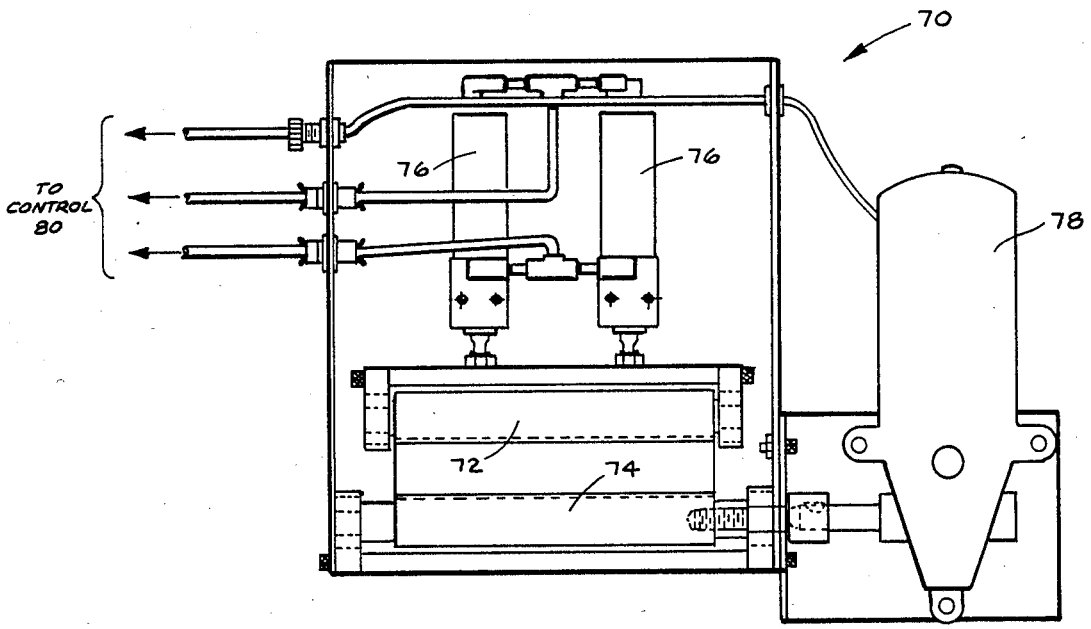
FIG. 2 is a view taken along a plane indicated by line 2—2 of FIG. 1 illustrating in more detail an unload mechanism.

An unload mechanism 70 also is provided in order to rapidly convey punched stock away from the outfeed portion 52 after the second clamping and advancing mechanism 58 has released the stock. Referring particularly to FIG. 2, the outfeed mechanism 70 includes upper and lower pinch rolls 72, 74 supported for rotation by bearings. The pinch roll 72 is movable vertically from a closed position where stock is tightly gripped to an open position where the stock is released. Vertical movement of the pinch roll 72 is controlled by a pair of pneumatic cylinders 76. The pinch roll 74 is driven by a gear motor 78. As will be apparent from FIG. 2, whenever the roll 72 is lowered and the roll 74 is rotated, any stock disposed intermediate the rolls 72, 74 will be moved.

Figure 3:
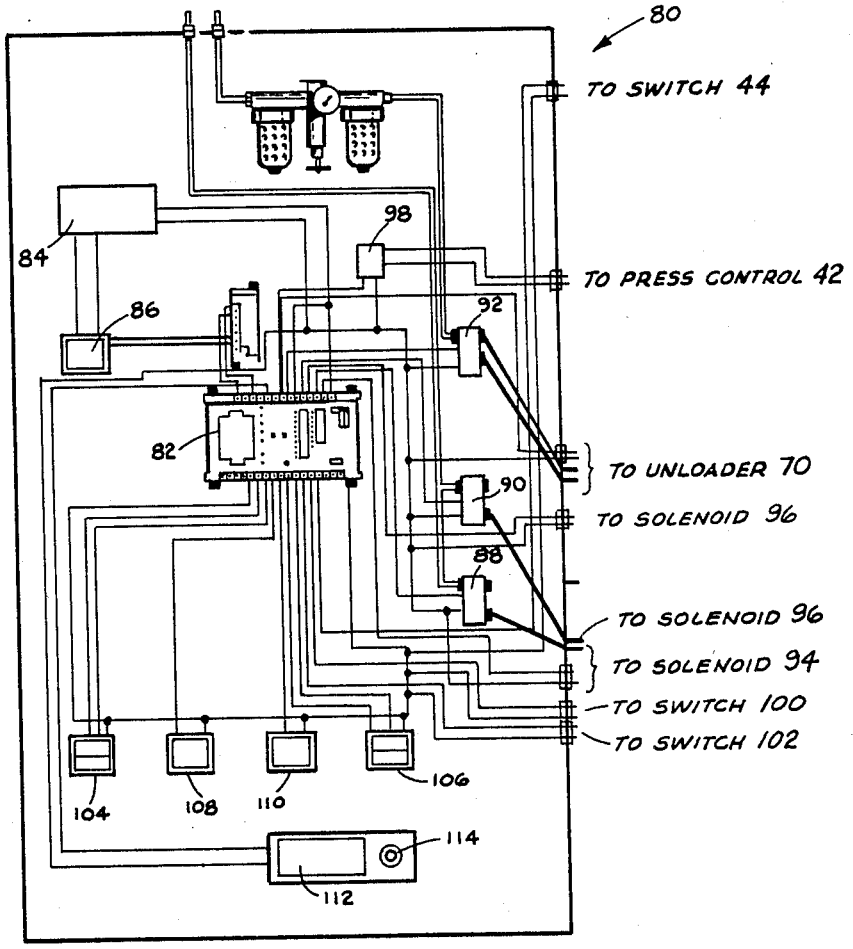
FIG. 3 is an enlarged view of a control means employed as part of the invention.

A control means 80 (FIG. 3) is provided to correlate operation of the press 10, including the clamping and advancing mechanisms 56, 58. The control means 80 includes a programmable controller 82. The programmable controller 82 is commercially available from Omron Electronics, Inc., Control Components Division, Schaumburg, Ill. 60195, under the model designation SYSMAC-S6.

The control means 80 includes a 110-volt power supply 84, an on-off switch 86, solenoids 88, 90, 92, 94, 96, a relay 98, and microswitches 100, 102. The control means 80 also is connected to the press control 42, the rotary cam switch 46, and the unloader 70.

The control means 80 includes various input functions such as a mode select switch (automatic or manual) 104, a feed select switch (feed 1 or feed 2) 106, a manual feed switch 108, and a manual load switch 110. The control means 80 also includes a counter 112 by which the operator can determine the number of machine operations, or counts, that have occurred, and a reset button 114 for resetting the counter.

As can be seen from an examination of FIG. 1, the microswitch 100 senses the position of the connecting rod 26. The microswitch 100 activates solenoids 94, 96 with each cycle of the press 10. When the connecting rod 26 is in its raised position, the microswitch 100 is released, which in turn causes the clamps 63 to be released and the clamps 64 to grip the stock and move it in the feed direction. The microswitch 102 senses the extreme forward position of the movable clamp 64 of the clamping and advancing mechanism 56, thereby providing a signal to the control means 80 indicating the completion of a feed stroke. The solenoids 94, 96 control operation of the first and second clamping mechanisms 56, 58 respectively.

OPERATION

The operator places the mode select switch 104 in manual mode, and the feed select switch 106 is switched to feed 1. The operator depresses the manual load switch 110, which causes the solenoid 88 to be in an exhaust status, which in turn causes the first clamping and advancing mechanism 56 to be in an open position, allowing the operator to insert stock material through the first clamping and advancing mechanism 56 and to the punching station 54. The stock is inserted beneath the punch 32 to Point A (FIG. 1). Point A is the starting position for the leading edge of the stock.

After the leading edge of the stock has been positioned at Point A, the operator again depresses the manual load switch 110 to cause solenoid 88 to supply air pressure to the first clamping and advancing mechanism 56. Consequently, the first clamping and advancing mechanism 56 grips the stock and is in a ready-to-run status. The operator depresses the rest button 114 in order to set the counter 112 to a zero status. The operator then depresses the foot pedal 44 which causes the press 10 to cycle, and the first clamping and advancing mechanism 56 to cycle until the leading edge of the stock has reached a point at which the second clamping mechanism 58 can engage the stock to pull the stock through the press 10. The operator then releases the foot pedal 44 which causes the press 10 to stop.

The operator observes the number of cycles, or counts, that have occurred on the counter 112 as received from the rotary cam switch 46. This enables a first predetermined count. The operator enters the first predetermined count into the memory of the programmable controller 82. The operator then presses the feed select swich 106 to select the second advancing and clamping mechanism 58 (feed 2), which causes the solenoid 90 to supply air pressure to the second clamping and advancing mechanism 58. The operator then depresses the foot pedal 44, causing the press 10 to cycle and the second clamping and advancing mechanism 58 to cycle until the trailing edge of the stock reaches Point B. Point B is the point at which the last whole part can be made from the stock. The operator then releases the foot pedal 44 causing the press 10 to stop.

The operator observes the number of cycles that have occurred from the time when the leading edge of the stock was at Point A until the trailing edge of the stock is at Point B. This number of cycles establishes a second predetermined count. The operator enters the second predetermined count into the memory of the programmable controller 82. The operator then moves the feed select switch 106 to feed 1 in order to permit removal of the stock that has just been processed. Then, either by use of the feed select switch 106 or the manual load switch 110, the operator releases the clamping action provided by the first clamping and advancing mechanism 56.

The operator thereafter places the next piece of stock through the first clamping and advancing mechanism 56 to Point A, and turns the mode select switch 104 to automatic. This action causes the solenoid 88 to be switched to the supply position and to cause the first clamping and advancing mechanism 56 to grip the stock. The operator then depresses the foot pedal 44, which causes the machine then to cycle and to continue to cycle, automatically changing from the first clamping and advancing mechanism 56 to the second clamping and advancing mechanism 58 upon reaching the first predetermined count, without any pause in the operation of the machine when this feed change occurs.

In order to properly coordinate the feed stroke with the press cycle, the microswitch 102 is employed in conjunction with the first predetermined count so that the feed change will occur only after both the first predetermined count and the feed stroke completion signal have occurred. If the microswitch 102 was not available to sense the position of the clamp 64, the solenoid 88 would stop the supply of air to the first clamping and advancing mechanism 56 upon the attainment of the first predetermined count, even if the feed stroke had not been completed. In that circumstance, an incorrect feed length would result. By causing the feed change to occur only after the first predetermined count has been attained and after the microswitch 102 has been activated, the next cycle of the press 10 will occur only after the stock has been advanced a proper length.

Upon reaching the second predetermined count, the press 10 stops automatically whether the operator releases the foot pedal 44 or not. This is accomplished by the relay 98. The relay 98 interrupts the press's emergency stop circuit. The programmable controller 82 switches the solenoid 90 to the exhaust position which causes the second clamping and advancing mechanism 58 to release its grip upon the stock that has just been processed. The controller 82 also activates the solenoid 92 in order to move the upper roll 72 downwardly to a stock-engaging position. The controller 82 also causes the gear motor 78 to be activated in order to rotate the lower roll 74, thereby removing the just-punched piece of stock from the second clamping and advancing mechanism 58 and the outfeed portion 52.

At any time after the second clamping and advancing mechanism 58 has started to operate or at any time during the loading operation, the operator can position the next piece of stock material through the infeed portion 50 until the leading edge of the stock is at Point A. The length of time the unload mechanism 70 is in operation is normally 4 to 8 seconds. When the unloading time has passed, the controller 82 switches the solenoid 92 such that the roll 72 is raised to an open position, and the gear motor 78 is switched to an off position. The solenoid 88 is switched to the supply position which causes the first clamping and advancing mechanism 56 to engage the stock. The controller 82 thereafter releases its inhibit status on the press's emergency stop circuit and, provided the operator has depressed the foot pedal 44, the press 10 will run and the feed, feed change, and unload functions will occur automatically.

As will be apparent from the foregoing description, the invention enables the operator to rapidly position stock at the infeed portion of the press. Once the stock has been properly positioned at the infeed portion, it essentially is processed automatically. Because it is impossible for additional punching operations to be performed upon a piece of stock after the trailing edge of the stock has reached Point B, the possibility of damage to the press due to improper loading of the punch is avoided. By use of the present invention, exceedingly rapid production rates on the order of 6,000 parts per hour can be obtained. This significant rate of production is available at very little component cost as should be apparent from an examination of the various components employed with the invention. Yet additionally, the invention can be operated easily and without requiring any special training on the part of the machine operator.

Although the invention has been described with a certain amount of particularity, it will be understood that the present disclosure of the preferred embodiment has been made only by way of example. Various changes in the details of construction may be resorted to without departing from the true spirit and scope of the invention as hereinafter claimed, and it is intended that the appended claims shall encompass all such changes.

What is claimed is:

1. A feed system for delivering individual pieces of stock to a punch press, the press having a punching station, an infeed portion upstream of the punching station, an outfeed portion downstream of the punching station, and a control mechanism to control operation of the press, the combination comprising:

a first clamping and advancing means upstream of the infeed portion for gripping the stock and advancing the stock through the infeed portion toward the punching station;

a second clamping and advancing means downstream of the outfeed portion for gripping the stock and advancing the stock through the outfeed portion away from the punching station;

control means in communication with the first clamping and advancing means, the second clamping and advancing means, and the press for operating the press a predetermined number of cycles to perform a predetermined number of operations upon a given piece of stock, the control means causing the punch to stop after the predetermined number of operations have been attained regardless of whether the control mechanism has been disengaged, the control means further causing the first clamping and advancing mechanism to feed stock through the infeed portion and the punching station while the second clamping and advancing mechanism is deactivated, the first clamping and advancing mechanism feeding the stock a predetermined number of counts, the predetermined number of counts causing the feed stock to be positioned adjacent the second clamping and advancing mechanism; and the control means further causing the second clamping and advancing mechanism to be actuated after the predetermined number of counts has been attained.

2. The feed system of claim 1, further comprising conveying means disposed downstream of the outfeed portion and the second clamping and advancing mechanism for engaging punched stock and conveying the punched stock away from the outfeed portion.

3. The feed system of claim 1, wherein the first clamping and advancing means is pneumatically operated.

4. The feed system of claim 1, wherein the second clamping and advancing means is pneumatically operated.

5. The feed system of claim 1, wherein the first clamping and advancing mechanism is deactivated upon activation of the second clamping and advancing mechanism.

6. The feed system of claim 1, wherein the control means causes the second clamping and advancing mechanism to be actuated after the predetermined number of counts has been attained and after the first clamping and advancing mechanism has achieved its full advance position.

7. A feed system for delivering stock to a punch press, the press having a punching station, an infeed portion upstream of the punching station, an outfeed portion downstream of the punching station, and a control mechanism to control operation of the press, the combination comprising:

first, pneumatically operated clamping and advancing means located upstream of the infeed portion for gripping the stock and advancing the stock through the infeed portion toward the punching station;

second, pneumatically actuated clamping and advancing means located downstream of the outfeed portion for gripping the stock and advancing the stock through the outfeed portion away from the punching station; and control means in communication with the first clamping and advancing means, the second clamping and advancing means, and the press for operating the press and the first clamping and advancing means a first predetermined number of cycles to perform a first predetermined number of operations upon a given piece of stock while the second clamping and advancing mechanism is deactivated, the first clamping and advancing mechanism feeding the stock through the punching station to a position adjacent to the second clamping and advancing mechanism, the control means causing the second clamping and advancing means to be activated to convey the stock through the outfeed portion, the second clamping and advancing mechanism being actuated a second predetermined number of operations, the control means causing the punch to stop after the second predetermined number has been attained regardless of whether the control mechanism has been disengaged.

8. A method for delivering stock to a punch press, comprising the steps of:

pushing a piece of stock toward the press;

performing punching operations upon the stock after the stock has been delivered to the press;

counting the number of operations performed upon the stock;

comparing the counted number of operations with a first predetermined number; and pulling the stock away from the press after the number of operations matches the predetermined number.

9. The method of claim 8, further comprising:

counting the number of operations performed upon the stock after the step of pulling has been commenced;

comparing the number of operations with a second predetermined number; and stopping the step of performing punching operations after the second predetermined number has been attained.

10. The method of claim 9, further comprising the step of removing the punched stock from the press while the press is stopped.

11. The method of claim 8, further comprising the step of stopping the step of pushing after the first predetermined number has been attained.

12. The method of claim 8, wherein the step of pushing is carried out in increments, the method further comprising:

sensing whenever the step of pushing has been completed; and commencing the step of pulling only after the end of a pushing increment has been sensed.

* * * * *